US010317106B2

(12) United States Patent
Nakatsu et al.

(10) Patent No.: US 10,317,106 B2
(45) Date of Patent: Jun. 11, 2019

(54) AIR CONDITIONER

(71) Applicant: Johnson Controls-Hitachi Air Conditioning Technology (Hong Kong) Limited, Hong Kong (CN)

(72) Inventors: Yuki Nakatsu, Tokyo (JP); Koichi Tokushige, Tokyo (JP); Seigo Okamura, Tokyo (JP)

(73) Assignee: Hitachi-Johnson Controls Air Conditioning, Inc., Tokyo (JP)

( * ) Notice: Subject to any disclaimer, the term of this patent is extended or adjusted under 35 U.S.C. 154(b) by 101 days.

(21) Appl. No.: 15/518,002

(22) PCT Filed: Sep. 16, 2015

(86) PCT No.: PCT/JP2015/076251
§ 371 (c)(1),
(2) Date: Apr. 10, 2017

(87) PCT Pub. No.: WO2016/080062
PCT Pub. Date: May 26, 2016

(65) Prior Publication Data

US 2017/0307238 A1 Oct. 26, 2017

(30) Foreign Application Priority Data

Nov. 19, 2014 (JP) ..... 2014-234101

(51) Int. Cl.
*F24F 11/89* (2018.01)
*F24F 11/30* (2018.01)
(Continued)

(52) U.S. Cl.
CPC ..... *F24F 11/89* (2018.01); *F24F 11/30* (2018.01); *F24F 2001/0066* (2013.01);
(Continued)

(58) Field of Classification Search
CPC .... F24F 11/30; F24F 11/89; F24F 2001/0066; F24F 2110/00; F24F 2110/10; F24F 2110/20; F25D 2600/02; F25D 2700/02
(Continued)

(56) References Cited

U.S. PATENT DOCUMENTS

2004/0204793 A1* 10/2004 Yoon ..... G05D 23/1905 700/277
2006/0090483 A1* 5/2006 Kim ..... F24F 11/30 62/126
2009/0139251 A1* 6/2009 Masui ..... F25B 13/00 62/129
2009/0145147 A1* 6/2009 Kojima ..... F24F 1/0003 62/157
2013/0325191 A1* 12/2013 Mukai ..... G05B 13/02 700/276

FOREIGN PATENT DOCUMENTS

JP 06-034190 A 2/1994
JP 10-068546 A 3/1998
(Continued)

OTHER PUBLICATIONS

English translation of Abstract of KR 2009066828 A to Dong Hwan, Jun. 2009. (Year: 2009).*
(Continued)

*Primary Examiner* — Marc E Norman
(74) *Attorney, Agent, or Firm* — Mattingly & Malur, PC

(57) ABSTRACT

In the control device 12 of the indoor unit 11, a plurality of communication means 14*a* to 14*c* having different communication speeds; communication speed recognizing means 18 for recognizing whether or not a communication line 15 from an outdoor unit 10 is connected to any of the communication means, from the communication speed of the control information signal; and communication means confirmation means 18 for confirming the communication means
(Continued)

that performs the following communication based on the recognized communication speed, are provided. According to this, it is possible to recognize the communication speed of an input signal without providing a manual changeover switch. Therefore, it is possible to solve at least one or more of the problems that the installation work is complicated, that a setting error of the changeover switch is likely to be generated, and that the product prices increase.

8 Claims, 7 Drawing Sheets

(51) Int. Cl.

| | |
|---|---|
| *F24F 110/20* | (2018.01) |
| *F24F 110/00* | (2018.01) |
| *F24F 110/10* | (2018.01) |
| *F24F 1/00* | (2019.01) |

(52) U.S. Cl.
CPC ..... *F24F 2110/00* (2018.01); *F24F 2110/10* (2018.01); *F24F 2110/20* (2018.01); *F25D 2600/02* (2013.01); *F25D 2700/12* (2013.01)

(58) Field of Classification Search
USPC ..... 340/13.27, 13.33
See application file for complete search history.

(56) References Cited

FOREIGN PATENT DOCUMENTS

| | | | |
|---|---|---|---|
| JP | 2005-061676 | A | 3/2005 |
| JP | 2012-149801 | A | 8/2012 |
| KR | 10-2009-0066828 | A | 6/2009 |
| KR | 10-2014-0112757 | A | 9/2014 |

OTHER PUBLICATIONS

Jan. 9, 2018 Office Action issued in Japanese Patent Application No. 2014-234101.
International Search Report of PCT/JP2015/076251 dated Dec. 22, 2015.
Extended European Search Report received in corresponding European Application No. 15860354.8 dated May 24, 2018.

* cited by examiner

[Fig. 1]
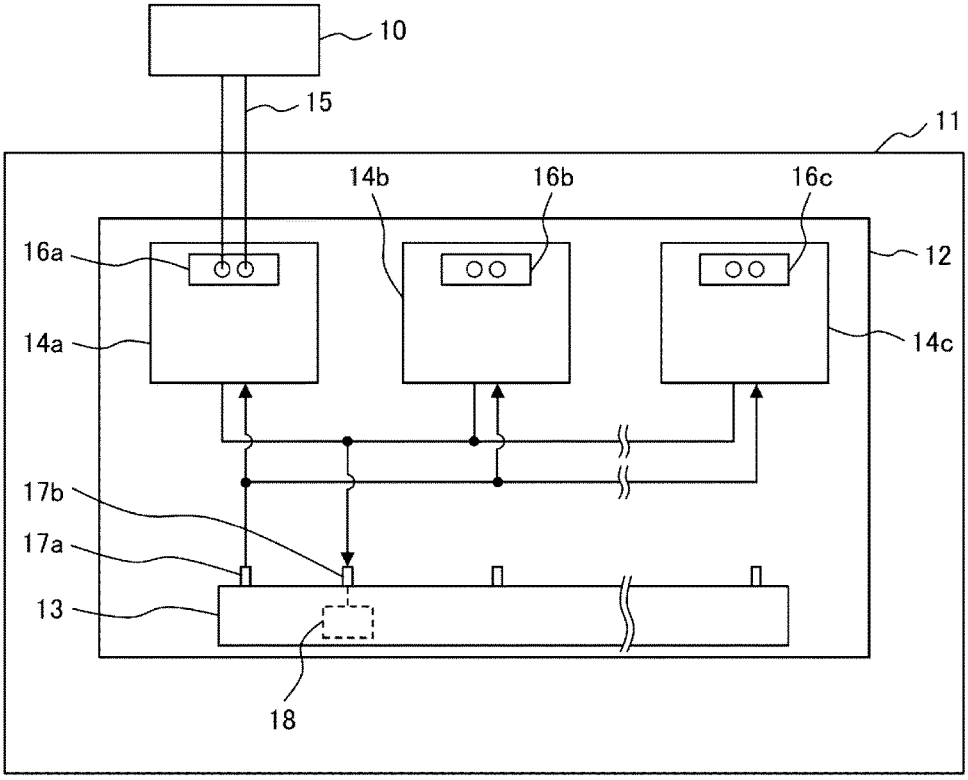

[Fig. 2]
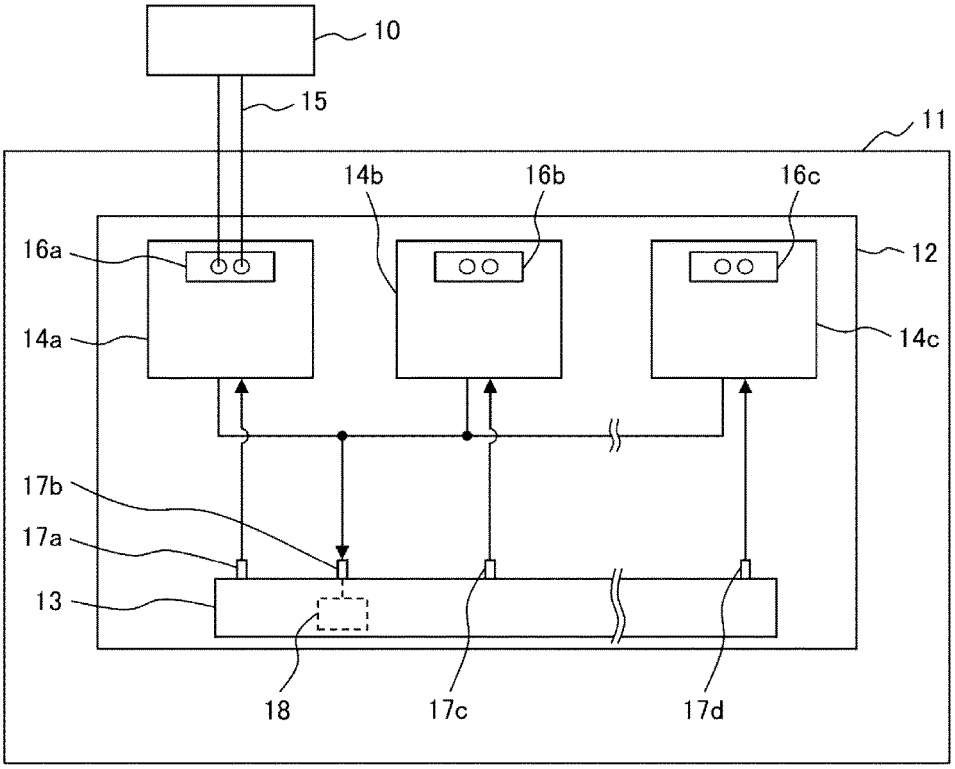

[Fig. 3]
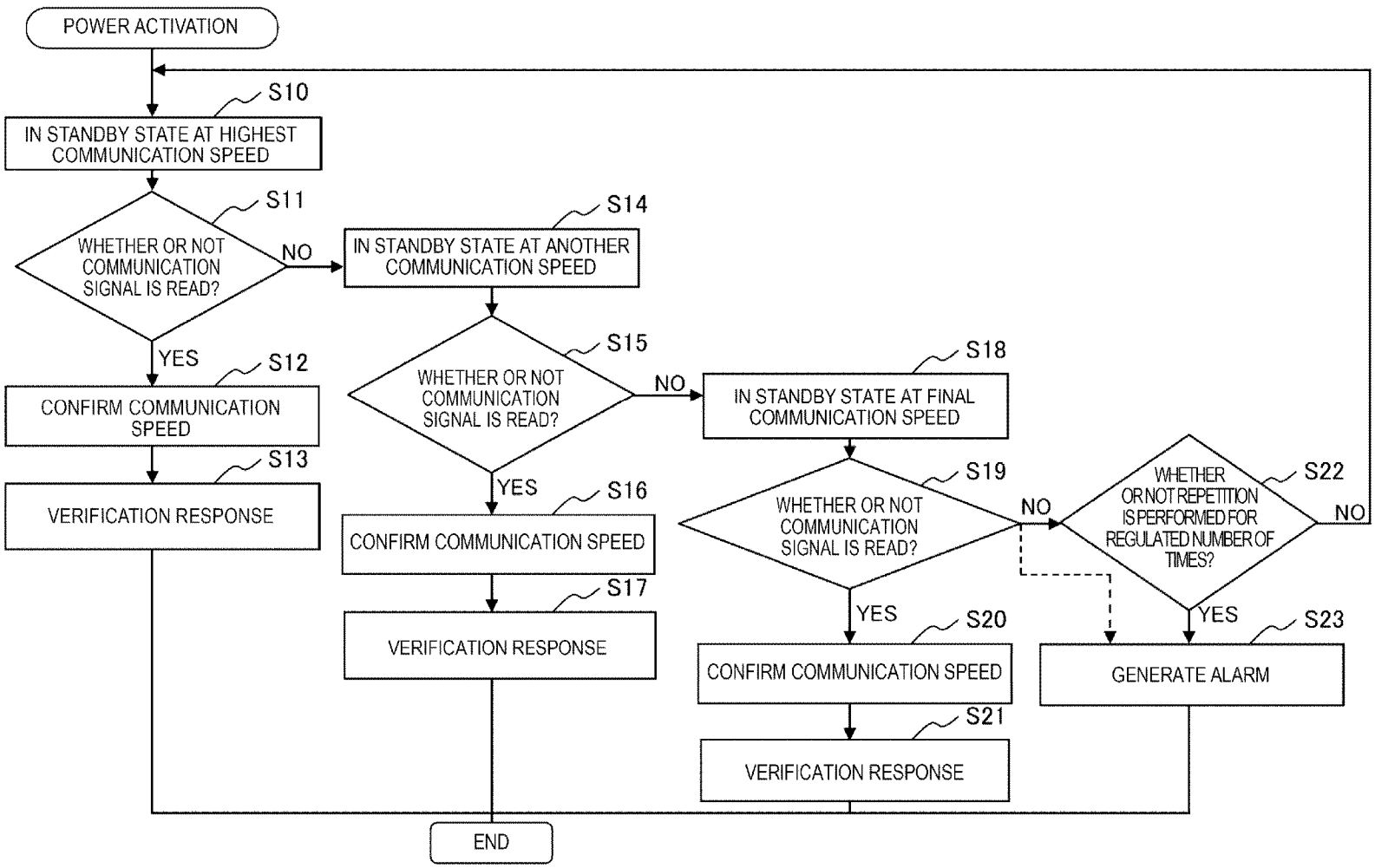

[Fig. 4]
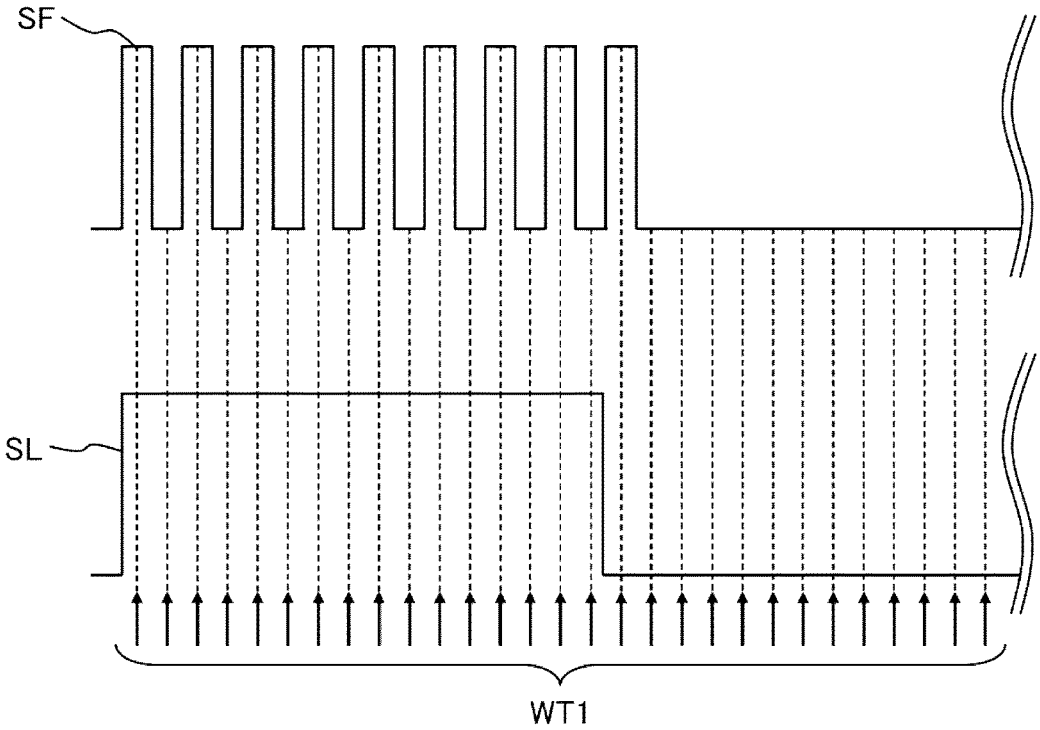
[Fig. 5]
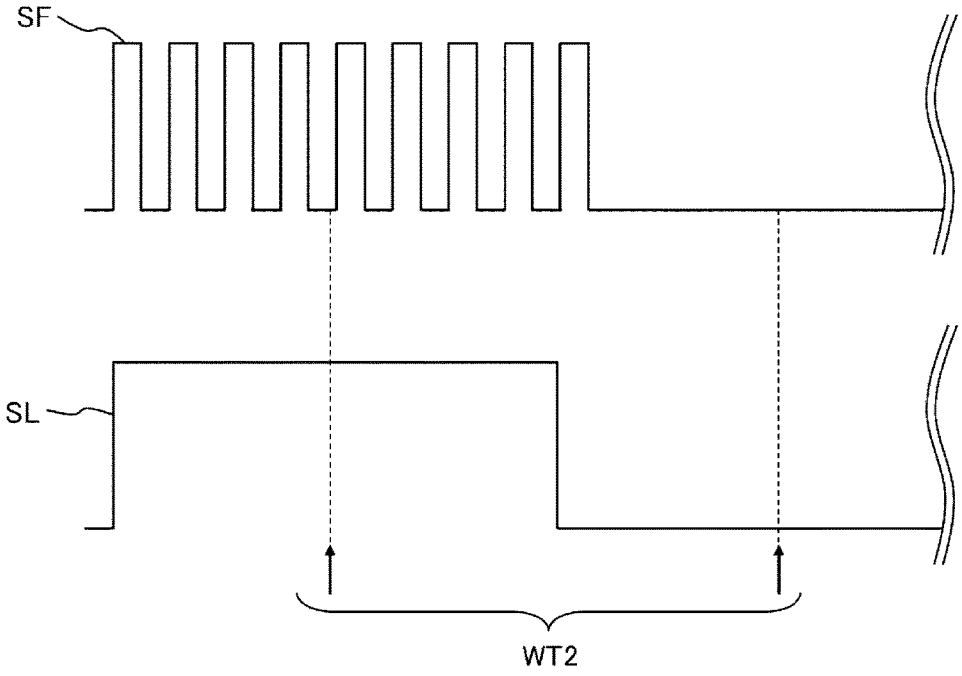

[Fig. 6]
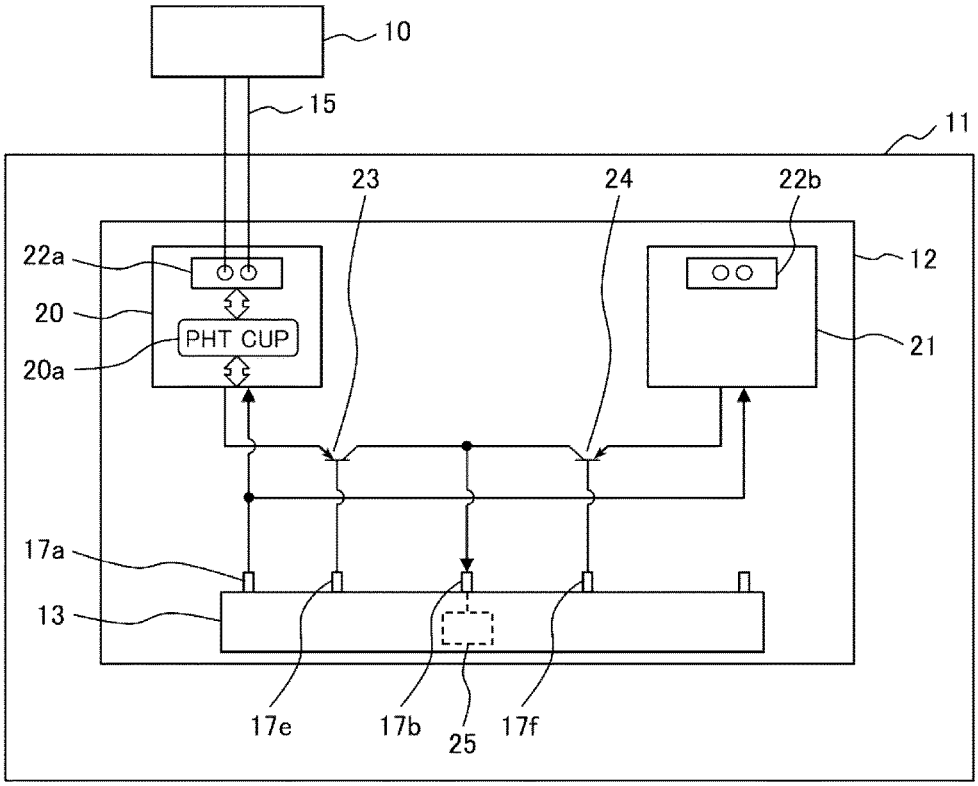

[Fig. 7]
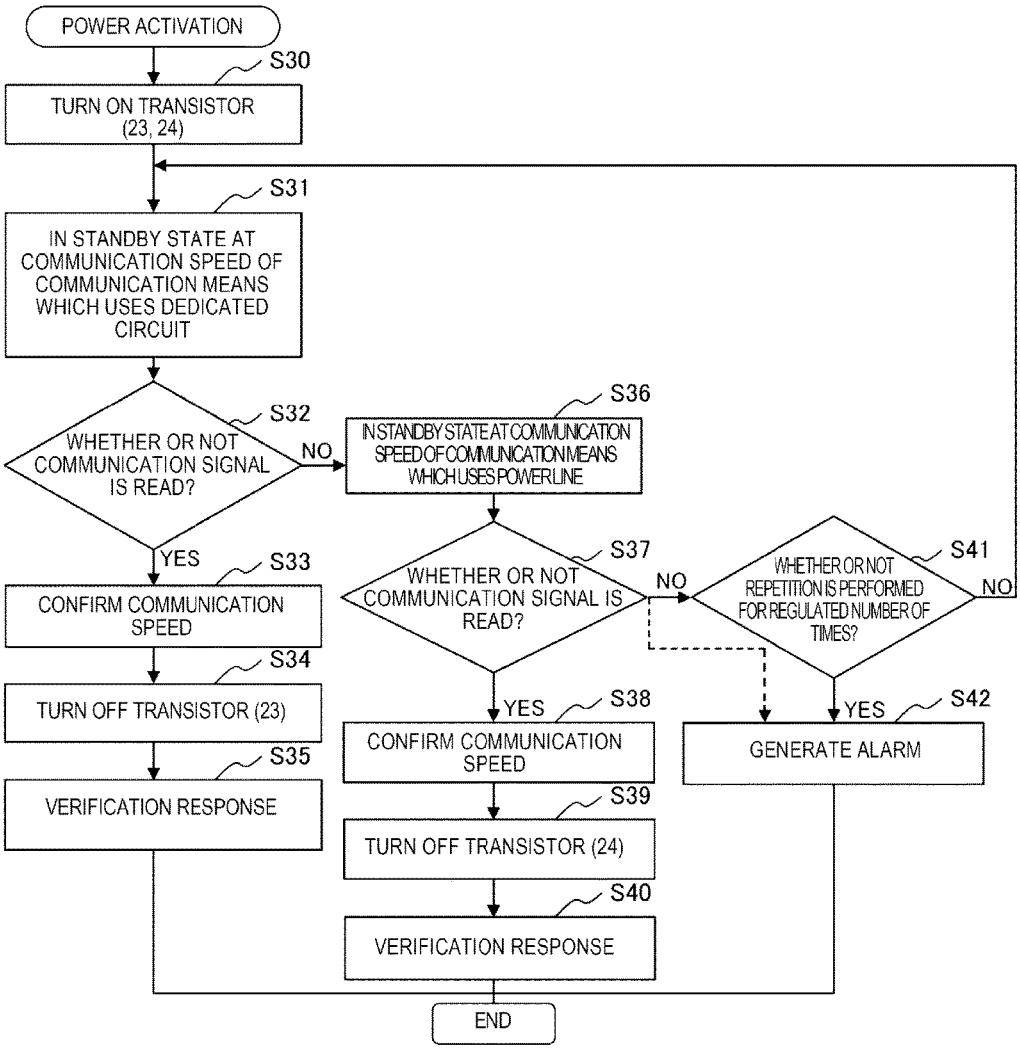

[Fig. 8]
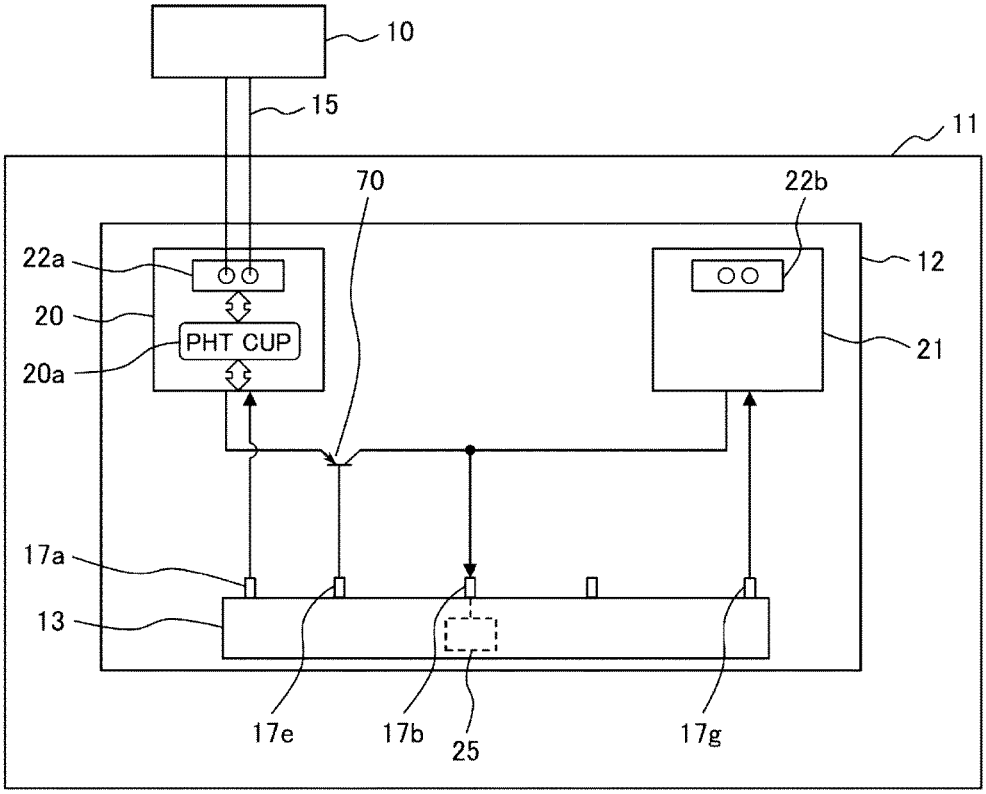

AIR CONDITIONER

TECHNICAL FIELD

The present invention relates to an air conditioner which controls a temperature or humidity of a dwelling space or the like, and particularly to a separation type air conditioner configured of an outdoor unit and an indoor unit.

BACKGROUND ART

In such a separation type air conditioner, in order to allow the entire air conditioner to perform an optimal operation, it is necessary to transmit information by performing two-way communication between a control device of the indoor unit and a control device of an outdoor unit. For example, commands of an operation request, a change in set temperature, a timer, a change in operation mode, or a stop request, which are input by a user via a remote controller, an indoor temperature output from a temperature detection circuit or the like, an ON/OFF command of a refrigerant compressor of the outdoor unit, and the like are sent from the control device of the indoor unit to the control device of the outdoor unit.

In addition, a rotating speed of a refrigerant compressor of the outdoor unit, failure information of the outdoor unit, outdoor temperature information, and the like are sent from the control device of the outdoor unit to the control device of the indoor unit. In addition, each of the control devices is controlled to be integrally operated by exchanging control information signals, such as a signal about an operation condition or a set temperature.

Such an air conditioner is suggested in Japanese laid-open No. 2005-61676 (PTL 1) or the like, but is also suggested in many other PTLs or the like. However, as the above-described method of transmitting the control information signal, a method of transmitting a signal pulse which is a transmission signal at a predetermined frequency by connecting the control devices of the outdoor unit and the indoor unit to each other by a dedicated signal line, is known. In addition to this, a method of transmitting information by using an AC current of a power line which supplies power to the control devices of the outdoor unit and the indoor unit, is also known.

In general, as communication means of each of the control devices of the outdoor unit and the indoor unit of the air conditioner, at least two communication means having different communication speeds are mainly used, and in the related art, as a switching method of the communication speed, switching is performed by using a manual changeover switch. For example, the manual changeover switch is provided in the control device of the outdoor unit or the control device of the indoor unit, or in the control devices of the outdoor unit and the indoor unit, and the communication means is selected by switching each of the manual changeover switches in accordance with a communication speed selected by an installation worker of the air conditioner.

CITATION LIST

Patent Literature

PTL 1: Japanese laid-open No. 2005-61676

SUMMARY OF INVENTION

Technical Problem

Therefore, as the communication means between the control devices of the outdoor unit and the indoor unit of the air conditioner, in the air conditioner in which at least one of the two communication means having different communication speeds is used, an input of any control information signal having different communication speeds is assumed. Therefore, the control device of the indoor unit which has a microcomputer as a main configuration element decides the communication speed of the control information signal by reading set information of the manual changeover switch.

In this manner, it is necessary for the installation worker or the like of the air conditioner to perform switching work of the changeover switch which selects the communication speed, and there are problems that installation work is complicated, that a setting error of the changeover switch is likely to be generated, and that a normal operation of the air conditioner cannot be ensured. In addition, there is also a problem that the product prices increase since it is necessary to provide the manual changeover switch or an electric circuit related to the manual changeover switch in the control device of the outdoor unit or the indoor unit, and product competitiveness decreases.

An object of the present invention is to provide a new air conditioner which can recognize a communication speed of a control information signal without providing a manual changeover switch.

Solution to Problem

Characteristics of the present invention are that, in the control device of the indoor unit, a plurality of communication means having different communication speeds; communication speed recognizing means for recognizing whether or not the communication line from the outdoor unit is connected to any of the communication means, from the communication speed of the control information signal; and communication means confirmation means for confirming the communication means that performs the following communication based on the recognized communication speed, are provided.

Advantageous Effects of Invention

According to the present invention, it is also possible to recognize the communication speed of the input signal without providing the manual changeover switch. Therefore, it is possible to solve at least one or more of the problems that the installation work is complicated, that a setting error of the changeover switch is likely to be generated, and that the product prices increase.

BRIEF DESCRIPTION OF DRAWINGS

FIG. 1 is a configuration view of an air conditioner according to a first embodiment of the present invention.

FIG. 2 is a configuration view of an air conditioner according to a modification example of the first embodiment.

FIG. 3 is a flowchart illustrating a control flow which authorizes a communication speed and is performed in the first embodiment.

FIG. 4 is a view describing a first authorizing method of the communication speed in the control flow illustrated in FIG. 3.

FIG. 5 is a view describing a second authorizing method of the communication speed in the control flow illustrated in FIG. 3.

FIG. 6 is a configuration view of an air conditioner according to a second embodiment of the present invention.

FIG. 7 is a flowchart illustrating a control flow which authorizes a communication speed and is performed in the second embodiment.

FIG. 8 is a configuration view of an air conditioner according to a third embodiment of the present invention.

DESCRIPTION OF EMBODIMENTS

Hereinafter, the embodiments of the present invention will be described in detail by using the drawings, but the present invention is not limited to the following embodiments, and also includes various modification examples and application examples in the range thereof in the technical concept of the present invention.

Example 1

A first embodiment of the present invention will be described in detail based on FIGS. 1 to 5. In FIG. 1, a reference number 10 is an outdoor unit which configures an air conditioner, and a refrigerant of which a temperature or a flow quantity is controlled in the outdoor unit 10 is supplied by a pipe which is not illustrated to an indoor unit 11 that also configures the air conditioner. Air of which the temperature or humidity is controlled is supplied to the inside of a room by exchanging the heat of the refrigerant and the heat of the indoor air by a blower built in the indoor unit 11. Since a configuration or an operation of the air conditioner is well known, the description thereof will be omitted.

In addition, as illustrated in FIG. 1, a control device 12 is built in the indoor unit 11. Since the control device 12 operates the air conditioner in a known manner and the configuration and the operation thereof are well known, the description which is not related to the example will be omitted.

The control device 12 has a microcomputer 13 as a main configuration element, and the microcomputer 13 includes an arithmetic operation portion which performs arithmetic operation processing according to a control program, a ROM region portion which stores the control program or a constant that is used in an arithmetic operation therein, and a RAM region portion as a work area which temporarily stores data necessary for an execution process of the program. An I/OLSI which takes in a sensor signal or a button signal and supplies a driving signal to a driving actuator, is further provided. The microcomputer 13 performs various arithmetic operation processing by the control program, but the arithmetic operation is an operation for implementing a predetermined control function, so that the processing performed by the arithmetic operation is regard as a function In the present embodiment.

In the control device 12, a plurality of communication means 14*a*, 14*b*, and 14*c* having different communication speeds are provided. In the embodiment, three communication means 14*a*, 14*b*, and 14*c* are illustrated an example, but at least two or more communication means are provided. Furthermore, since the communication speed is determined in advance in a design stage of the air conditioner, the communication means 14*a*, 14*b*, and 14*c* which correspond to the communication speed are prepared in the control device 12. In each of the communication means 14*a*, 14*b*, and 14*c*, connection terminals 16*a*, 16*b*, and 16*c* which are connected to the control device of the outdoor unit 10 via a communication line 15 are provided, and the communication line 15 is connected to any of the terminals 16*a*, 16*b*, and 16*c*. Furthermore, In the present embodiment, the communication line 15 is configured as a dedicated communication line dedicated for communication.

Here, In the present embodiment, since a manual changeover switch of the related art is not provided, set information is not input to the control device 12 on the indoor unit 11 side by the manual changeover switch. Therefore, the communication speed of the control information signal communicated by the communication line 15 is not known in the control device 12.

By not providing the manual changeover switch, it is possible to solve at least one or more of the problems that the installation work is complicated, that a setting error of the changeover switch is likely to be generated, and that the product prices increase, which are described in "Technical Problem". However, since the communication speed of the control information signal is not known in the control device 12, it is necessary to determine the communication speed of the control information signal. The example has characteristics in which the communication speed is recognized by the control device 12, and the recognizing method will be described based on FIGS. 3 to 5.

Each of the communication means 14*a*, 14*b*, and 14*c* is connected to a common output port 17*a* of the microcomputer 13 and a common input port 17*b* through a bus line. Therefore, the control information signal having a certain communication speed is input to the input port 17*b*, and a verification response signal which confirms the communication means 14*a*, 14*b*, and 14*c* is output from the output port 17*a*. When the communication means is confirmed, the following communication is performed by the confirmed communication means.

Furthermore, as illustrated in FIG. 2, it is possible to connect the communication means 14*a*, 14*b*, and 14*c* to each of the corresponding output ports 17*a*, 17*c*, and 17*d*. However, as illustrated In the present embodiment illustrated in FIG. 1, it is possible to save the number of input and output ports of the microcomputer 13 by making the input and output ports 17*a* and 17*b* common, there is an effect that insufficiency of the ports of the microcomputer 13 can be solved.

A communication speed recognizing function portion 18 is constructed in the microcomputer 13, the control information signal having a certain communication speed is input from the input port 17*b* to the communication speed recognizing function portion 18. The communication speed recognizing function portion 18 has a function of recognizing whether or not the communication line 15 is connected to any of the connection terminals 16*a*, 16*b*, and 16*c* of each of the communication means 14*a*, 14*b*, and 14*c*, from the communication speed. The communication speed recognizing function portion 18 recognizes the communication speed of the control information signal by a control flow illustrated in FIG. 3. Hereinafter, the operation of the control flow will be described based on FIG. 3.

In FIG. 3, the control flow is performed at a start-up timing which corresponds to power activation, or is performed when reaching a predetermined start-up timing after the power activation. In the present embodiment, the flowchart of FIG. 3 is initiated in accordance with the start-up timing by the power activation.

<<Step S10>>

In step S10, a reading timing which corresponds to a first communication speed which is the highest among those of the communication means 14*a*, 14*b*, and 14*c* is set, and a standby state is achieved. The setting of the plurality of communication speeds is determined in advance in a design stage of the air conditioner, and the communication speed is stored in the ROM region portion of the microcomputer 13. In the present embodiment, three communication speeds are set, and a relationship of first communication speed>second communication speed>third communication speed is given. In addition, when the communication speed which is in a standby state first is set to be the highest, there is an effect that the processing of the communication speed recognition is finished quickly. In the present embodiment, the recognition is performed in order of first communication speed=>second communication speed=>third communication speed.

<<Step S11>>

Next, in step S11, it is determined that the control information signal sent from the outdoor unit 10 via the communication line 15 is read at a reading timing WT1 which corresponds to the first communication speed set in step S10. FIG. 4 illustrates a case where the highest first communication speed is set and a standby state is achieved. With respect to the reading timing WT1 set in step S10, a control information signal SF having a high communication speed is read at the reading timing WT1 which corresponds to the first communication speed, and thus, the current control information signal can be recognized as the control information signal SF having a high communication speed.

Meanwhile, regarding a control information signal SL having a low communication speed, the information which varies in accordance with the reading timing is read, and thus, the current control information signal cannot be recognized as the control information signal SF having a high communication speed.

In step S11, the process moves to step S12 when the control information signal is determined as the control information signal SF having a high communication speed, and the process moves to step S14 when the control information signal is not determined as the control information signal SF having a high communication speed.

<<Step S12>>

Since the control information signal is recognized as the control information signal SF having a high communication speed in step S11, the first communication speed is confirmed in step S12. Therefore, it is possible to recognize the control information signal sent from the outdoor unit 10 as the control information signal SF having a high communication speed.

<<Step S13>>

In step S13, the communication means which corresponds to the recognized first communication speed is confirmed as a regular communication means, the verification response signal is sent, and the following communication with the outdoor unit 10 is performed at the first communication speed. When the sending-out of the verification response signal is finished, the process proceeds to end, and the control flow is finished.

Meanwhile, the process moves to step S14 when the current control information signal is not recognized as the control information signal SF having a high communication speed in step S11.

<<Step S14>>

When the current control information signal is not recognized as the control information signal having a high communication speed in step S11, in step S14, the reading timing which corresponds to the second communication speed which is lower than the current first communication speed is set and a standby state is achieved.

<<Step S15>>

Next, in step S15, it is determined whether or not the control information signal sent from the outdoor unit 10 via the communication line 15 is read at a reading timing WT2 which corresponds to the second communication speed set in step S14. FIG. 5 illustrates a case where the communication speed is set to be low and a standby state is achieved. With respect to the reading timing WT2 set in step S14, the control information signal SL having a low communication speed is read at the reading timing WT2 which corresponds to the second communication speed, and thus, the communication speed of the current control information signal can be recognized as the control information signal SL of the second communication speed.

On the contrary, in the control information signal SF having the first communication speed which is a high communication speed, or the control information signal having the third communication speed which is further lower than that at the reading timing set in step S14, the information which varies in accordance with the reading timing is read, and thus, the current control information signal is not recognized as the control information signal having the second communication signal.

In step S15, the process moves to step S16 when it is determined that the control information signal has a communication speed of the second communication speed, and the process moves to step S18 when it is determined that the control information signal does not have the second communication speed.

<<Step S16>>

In step S15, the communication speed is recognized as the second communication speed of the control information signal SL, and thus, in step S16, the communication speed is confirmed. Therefore, it is possible to recognize the control information signal sent from the outdoor unit 10 as the control information signal SL having the second communication speed.

<<Step S17>>

In step S17, the communication means which corresponds to the recognized communication speed is confirmed as a regular communication means, the verification response signal is sent, and the following communication with the outdoor unit 10 is performed at the communication speed. When the sending-out of the verification response signal is finished, the process proceeds to end, and the control flow is finished.

Meanwhile, the process moves to step S18 when the current control information signal is not recognized as the control information signal having the second communication speed in step S15.

<<Step S18>>

When the current control information signal is not recognized as the control information signal having the second communication speed in step S15, in step S18, the reading timing which corresponds to the third communication speed that is lower than the current second communication speed is set and a standby state is achieved.

<<Step S19>>

Next, in step S19, it is determined whether or not the control information signal sent from the outdoor unit 10 via the communication line 15 is read at the reading timing which corresponds to the third communication speed set in step S18. The determination is performed by a method which is the same as the method illustrated in FIG. 4 or 5. Since a reading timing WT3 (not illustrated) is set in step S18, the control information signal communicated at the third communication speed is read at the reading timing WT3. Therefore, the communication speed of the current control information signal can be recognized as the control information signal of the third communication speed. On the contrary, in the control information signals having the first communication speed and the second communication speed which are higher than the third communication speed, the information which varies in accordance with the reading timing is read, and thus, the current control information signal is not recognized as the control information signal of the third communication speed.

In step S19, the process moves to step S20 when it is determined that the control information signal has the communication speed of the third communication speed, and the process moves to step S22 when it is determined that the control information signal does not have the third communication speed.

<<Step S20>>

In step S19, the control information signal of which the communication speed is the third communication speed is recognized, and thus, the communication speed is confirmed in step S20. Therefore, it is possible to recognize the control information signal sent from the outdoor unit 10 as the control information signal having the third communication speed.

<<Step S21>>

In step S21, the communication means which corresponds to the recognized communication speed is confirmed as a regular communication means, the verification response signal is sent, and the following communication with the outdoor unit 10 is performed at the communication speed. When the sending-out of the verification response signal is finished, process proceeds to end, and the control flow is finished.

Meanwhile, the process moves to step S22 when the current control information signal is not recognized as the control information signal having the third communication speed in step S19. In other words, when moving to step S22, the current control information sent from the communication line 15 is considered as information of a mistaken communication speed.

<<Step S22>>

In step S22, it is determined whether or not a flow of passing through step S11=>step S15=>step S19=>step S22 is repeated for a predetermined number of times. The process moves to step S23 when the repetition is performed for the predetermined number of times, and the process returns to step S10 in a case where the predetermined number of times of repetition is not achieved, so that the same operation is repeated. The predetermined number of times is arbitrary, but when the predetermined number of times increases, it is possible to improve possibility of recognition of the communication speed even when the communication state is not excellent. Furthermore, in a case where it is not necessary to perform repetition only for the predetermined number of times, the process may move to step S23 by the first determination in step S19 as illustrated by a broken line.

<<Step S23>>

In step S11, since the control information signal sent from the outdoor unit 10 is not read even though the repetition for the predetermined number of times is performed, it is determined that the communication is abnormal, and the alarm is generated. After this, the process proceeds to end and the control flow is finished.

Here, In the present embodiment, three types of communication speeds is described as an example, but in a case where there are more than three types of communication speeds, in control step S15 to step S18, control steps S14 to S17 of recognizing other communication speeds may be provided in accordance with the type of the communication speed.

According to the present example, by providing the plurality of communication means having different communication speeds in the control device of the indoor unit; the communication speed recognizing means for recognizing whether or not the communication line from the outdoor unit is connected to any of the communication means, from the communication speed of the control information signal; and the communication means confirmation means for confirming the communication means that performs the following communication based on the recognized communication speed, it is possible to recognize the communication speed of the input signal without providing the manual changeover switch. Therefore, it is possible to solve the problems that the installation work is complicated, that a setting error of the manual changeover switch is likely to be generated, and that the product prices increase.

Example 2

Next, a second embodiment of the present invention will be described by using FIGS. 6 and 7. In FIG. 6, the control device 12 of the indoor unit 11 which performs the communication with the outdoor unit 10 includes power line communication means 20 which uses the power line, and dedicated line communication means 21 to which the dedicated communication line having a communication speed different from that of the power line communication means 20 is connected. Here, the dedicated line communication means 21 is provided with a dedicated communication circuit. Each of the communication means 20 and 21 is provided with connection terminals 22*a* and 22*b* to which the communication line 15, which is connected to the outdoor unit 10 is connected, and the communication line 15 is connected to any of the connection terminals 22*a* and 22*b*.

Here, the power line communication means 20 which uses the power line is provided with a signal converting portion 20*a* by a photocoupler (PHT CUP), and a strong power signal is converted to a weak power signal and is converted to a signal level handled by the microcomputer 13.

Similar to FIG. 1, each of the communication means 20 and 21 is connected to the common output port 17*a* and the common input port 17*b* of the microcomputer 13 through the bus line. Therefore, the control information signal having a communication speed of any of the communication means 20 and 21 is input to the input port 17*b*, and the verification response signal which confirms any of the communication means 20 and 21 is output from the output port. When the communication means is confirmed, the following communication is performed by the confirmed communication means.

In addition, the power line communication means 20 which uses the power line and the dedicated line communication means 21 which uses the dedicated circuit are connected to the common input port 17*b*, and an opening and closing transistor 23 (hereinafter, will be described as a transistor 23) which can be ON/OFF by the control signal from an output port 17*e* is provided between the power line communication means 20 and the input port 17*b*. Similarly, an opening and closing transistor 24 (hereinafter, will be described as a transistor 24) which can be ON/OFF by the control signal from an output port 17*f* is provided between the dedicated line communication means 21 and the input port 17*b*.

Functions of the transistors 23 and 24 are for preventing influence of the communication signal which is not intended or assumed from the power line communication means 20 or the dedicated line communication means 21 which is not used, after the recognition of the communication speed is finished.

A communication speed recognizing function portion 25 is constructed in the microcomputer 13 similar to Example 1, and the control information signal having a certain communication speed is input from the input port 17*b* to the communication speed recognizing function portion 25. The communication speed recognizing function portion 25 has a function of recognizing whether or not the communication line 15 is connected to any of the connection terminals 22*a* and 22*b* of each of the communication means 20 and 21, from the communication speed. The communication speed recognizing function portion 25 recognizes the communication speed of the control information signal by the control flow illustrated in FIG. 7. Hereinafter, an operation of the control flow will be described based on FIG. 7.

In FIG. 7, the control flow is also performed at an start-up timing which corresponds to power activation similar to Example 1, or is performed when reaching a predetermined start-up after the power activation. In the present embodiment, the flowchart of FIG. 7 is initiated in accordance with the start-up timing by the power activation.

<<Step S30>>

In step S30, a control signal for turning on the transistors 23 and 24 is sent from the output ports 17*e* and 17*f* of the microcomputer 13, and according to this, the transistors 23 and 24 are turned on. Therefore, both of the power line communication means 20 which uses the power line and the dedicated line communication means 21 which uses the dedicated circuit are connected to the input port 17*b* of the microcomputer 13. Therefore, the control information signal from the power line communication means 20 or the dedicated line communication means 21 is input.

<<Step S31>>

In step S31, it is assumed that the communication line 15 is connected to the connection terminal 22*b* included in the dedicated line communication means 21, a standby state is achieved at the reading timing at which the communication is possible at the communication speed of the dedicated line communication means 21. Here, the communication speed of the dedicated line communication means 21 is higher than that of the power line communication means 20 which uses the power line, and a possibility to be used is also high, and thus, there is an effect that the processing of the communication speed recognition is finished quickly.

<<Step S32>>

Next, in step S32, the process moves to step S33 in a case where the control information signal sent from the outdoor unit 10 is read at the communication speed of the dedicated line communication means 21 set in step S31. Meanwhile, the process moves to step S36 in a case where the control information signal is not read. When the control information signal of the communication speed of the dedicated line communication means 21 is input to the input port 17*b*, the communication speed recognizing function portion 25 is in a standby state at the communication speed of the dedicated line communication means 21, and thus, it is possible to read the control information signal of the communication speed of the dedicated line communication means 21 similar to Example 1.

Meanwhile, when the control information signal of the communication speed of the power line communication means 20 which uses the power line is input, the communication speed recognizing function portion 25 is in a standby state at the communication speed of the dedicated line communication means 21, and thus, the control information signal of the communication speed of the power line communication means 20 is not read similar to Example 1.

<<Step S33>>

Since the current control information signal is recognized as the control information signal from the dedicated line communication means 21 in step S32, in step S33, the communication speed at this time is confirmed. Therefore, it is possible to recognize the control information signal sent from the outdoor unit 10 as the control information signal of the dedicated line communication means 21. The process moves to step S34 when the confirmation of the communication speed is finished.

<<Step S34>>

In step S34, since the current communication speed is confirmed at the communication speed of the dedicated line communication means 21, by outputting an OFF signal from the output port 17*e* to the transistor 23 disposed between the power line communication means 20 and the input port 17*b*, the transistor 23 is turned off and the connection between the power line communication means 20 and the input port 17*b* is blocked. Accordingly, it is possible to improve reliability of the communication since the communication signal which is not intended or assumed from the power line communication means 20 is not transmitted to the input port 17*b*. The process moves to step S35 when the OFF control of the transistor 23 is finished.

<<Step S35>>

In step S35, the verification response signal is sent considering the recognized dedicated line communication means as a regular communication means, and the following communication with the outdoor unit 10 is performed at the communication speed of the dedicated line communication means 21. When the sending-out of the verification response signal is finished, the process proceeds to end, and the control flow is finished.

Meanwhile, when the current control information signal is not recognized as the control information signal of the dedicated line communication means 21 in step S32, the process moves to step S36.

<<Step S36>>

When the current control information signal is not recognized as the control information signal from the dedicated line communication means 21 in step S32, in step S36, the reading timing which corresponds to the power line communication means 20 that uses the power line is set and a standby state is achieved.

<<Step S37>>

Next, in step S37, the process moves to step S38 in a case where the control information signal sent from the outdoor unit 10 is read at the communication speed of the power line communication means 20 set in step S36. Meanwhile, the process moves to step S41 in a case where the control information signal is not read. In step S37, similar to Example 1, when the control information signal having the communication speed of the power line communication means 20 is input to the input port 17*b*, the communication speed recognizing function portion 25 is also in a standby state at the communication speed of the power line communication means 20, and thus, it is possible to read the control information signal of the communication speed of the power line communication means 20 similar to Example 1. On the contrary, when the control information signal of the communication speed of the dedicated line communication means 21 is input, the communication speed recognizing function portion 25 is in a standby state at the communication speed of the power line communication means 20, and thus, similar to Example 1, the control information signal of the communication speed of the dedicated line communication means 21 is not read.

<<Step S38>>

Since the current control information signal is recognized as the control information signal from the power line communication means 20 in step S37, in step S38, the communication speed at this time is confirmed. Therefore, it is possible to recognize the control information signal sent from the outdoor unit 10 as the control information signal of the power line communication means 20. The process moves to step S39 when the confirmation of the communication speed is finished.

<<Step S39>>

In step S39, since the current communication speed is confirmed at the communication speed of the power line communication means 20, by outputting an OFF signal from the output port 17*e* to the transistor 24 disposed between the dedicated line communication means 21 and the input port 17*b*, the transistor 24 is turned off and the connection between the dedicated line communication means 21 and the input port 17*b* is blocked. Accordingly, it is possible to improve reliability of the communication since the communication signal which is not intended or assumed from the dedicated line communication means 21 is not transmitted to the input port 17*b*. The process moves to step S40 when the OFF control of the transistor 24 is finished.

<<Step S40>>

In step S40, since the verification response signal is sent considering the recognized power line communication means as regulated communication means, the following communication with the outdoor unit 10 is performed at the communication speed of the power line communication means 20. When the sending-out of the verification response signal is finished, the process proceeds to end, and the control flow is finished.

Meanwhile, the process moves to step S41 when the current control information signal is not recognized as the control information signal of the power line communication means 20 in step S37. In other words, when the process moves to step S41, the current control information sent from the communication line 15 is considered as information of a <<Step S41>>

In step S41, it is determined whether or not the flow of passing through step S32=>step S37=>step S41 is repeated for a predetermined regulated number of times. The process moves to step S42 when the repetition is performed for a predetermined number of times, and the process returns to step S31 in a case where the predetermined number of times of repetition is not achieved similar to Example 1, so that the same operation is repeated. When the number of times of repetition is large, it is possible to improve possibility of recognition of the communication speed even when the communication state is not excellent. Furthermore, in a case where it is not necessary to perform repetition only for the predetermined number of times, the process may move to step S42 by the first determination in step S19 as illustrated by a broken line.

<<Step S42>>

In step S42, since the control information signal sent from the outdoor unit 10 is not read even though the repetition for the predetermined number of times is performed, it is determined that the communication is abnormal, and the alarm is generated. After this, the process proceeds to end and the control flow is finished.

According to the present example, by providing the power line communication means and the dedicated line communication means which have different communication speeds in the control device of the indoor unit; the communication speed recognizing means for recognizing whether or not the communication line from the outdoor unit is connected to any of the communication means of the power line communication means and the dedicated line communication means, from the communication speed of the control information signal; and the communication means confirmation means for confirming the following communication means based on the recognized communication speed, it is possible to recognize the communication speed of the input signal without providing the manual changeover switch. Therefore, it is possible to solve the problems that the installation work is complicated, that a setting error of the changeover switch is likely to be generated, and that the product prices increase.

Furthermore, since the transistor for opening and closing the connection is provided between each of the communication means and the input port, the connection with the input port is blocked other than the recognized communication means. According to this, influence of the communication signal which is not intended or assumed from the communication means which is not used is prevented, after the recognition of the communication speed is finished.

Example 3

Next, a third embodiment of the present invention will be described by using FIG. 8, but basically, the configuration is similar to that of Example 2. In FIG. 8, the control device 12 of the indoor unit 11 which performs the communication with the outdoor unit 10 includes the power line communication means which uses the power line, and the dedicated line communication means 21 to which the dedicated communication line having a communication speed different from that of the power line communication means 20 is connected. Here, the dedicated line communication means 21 is provided with the dedicated communication circuit. Each of the communication means 20 and 21 is provided with the connection terminals 22*a* and 22*b* to which the communication line 15, which is connected to the outdoor unit 10 is connected, and the communication line 15 is connected to any of the connection terminals 22*a* and 22*b*.

The power line communication means 20 which uses the power line is provided with the signal converting portion 20*a* by the photocoupler (PHT CUP), and the strong power signal is converted to the weak power signal and is converted to a signal level handled by the microcomputer 13.

Similar to FIG. 2, each of the communication means 20 and 21 is connected to the common input port 17*b* of the microcomputer 13 through the bus line, and the control information signal of any of the power line communication means 20 and the dedicated line communication means 21 is input to the input port 17*b*.

Meanwhile, the output ports are individually connected to each of the communication means 20 and 21, the power line communication means 20 is connected to the output port 17*a*, the dedicated line communication means 21 is connected to an output port 17*g*, and the signals which confirm the each of the communication means 20 and 21 from each of the output ports 17*a* and 17*g* are individually output. This point is different from Example 2. By separating the output ports in this manner, it is possible to reliably confirm the communication means.

In addition, the power line communication means 20 and the dedicated line communication means 21 are connected to the common input port 17*b*, the transistor 23 which can be ON/OFF by the control signal from the output port 17*e* is provided between the power line communication means 20 which uses the power line and the input port 17*b*. Meanwhile, the transistor in Example 2 is omitted between the dedicated line communication means 21 which uses the dedicated circuit and the input port 17*b*. This point is also different from Example 2. In addition, the function of the transistor 23 is similar to that of Example 2. In this manner, the transistor 24 is omitted, and thus, it is possible to make the circuit configuration of the control device 11 simple, and additionally, the control flow can be simplified. Since the transistor 24 is omitted, in the flowchart illustrated in FIG. 7, it is possible to omit an instruction of an ON operation of the transistor 24 of step S30 and an instruction of an OFF operation of the transistor 24 of step S39. Furthermore, since other configurations are similar to those of Example 2, further description is omitted.

As described above, the present invention includes the plurality of communication means having different communication speeds in the control device of the indoor unit; the communication speed recognizing means for recognizing whether or not the communication line from the outdoor unit is connected to any of the communication means, from the communication speed of the control information signal; and the communication means confirmation means for confirming the communication means that performs the following communication based on the recognized communication speed.

According to this, it is possible to recognize the communication speed of the input signal without providing the manual changeover switch. Therefore, it is possible to solve at least one or more of the problems that the installation work is complicated, that a setting error of the changeover switch is likely to be generated, and that the product prices increase.

Furthermore, the present invention is not limited to the above-described examples, and various modification examples are included. For example, the above-described examples are described in detail for making it easy to understand the present invention, and it is not necessary to provide all of the described configurations. In addition, it is possible to replace a part of the configuration of the example with other examples, and to add the configurations of other examples to a certain example. In addition, regarding a part of the configurations of each example, other configurations can be added, removed, and replaced.

REFERENCE SIGNS LIST

10 . . . outdoor unit,
11 . . . indoor unit,
12 . . . control device,
13 . . . microcomputer,
14*a*, 14*b*, 14*c* . . . communication means,
15 . . . communication line,
16*a*, 16*b*, 16*c* . . . connection terminal,
17*a*, 17*b*, 17*c*, 17*d*, 17*e*, 17*f* . . . input and output port,
18 . . . communication speed recognizing function portion,
20, 21 . . . communication means,
20*a* . . . signal converting portion,
22*a*, 22*b* . . . connection terminal,
23, 24 . . . transistor

The invention claimed is:

1. An air conditioner comprising:

an outdoor unit including a first controller; and an indoor unit including:

a second controller that includes a plurality of communication terminals connected to the first controller of the outdoor unit via a communication line, the plurality of communication terminals respectively corresponding to different predetermined communication speeds, wherein the second controller of the indoor unit includes a microprocessor, programmed to:

receive a control information signal of a first communication speed, among the different predetermined communication speeds, via the communication line, determine which communication speed, of the predetermined different communication speeds, is the first communication speed of the control information signal based on evaluating a highest communication speed first among the different predetermined communication speeds, and determine which communication terminal, of the plurality of communication terminals, to perform subsequent communication with based on the determined communication speed of the control information signal.

2. The air conditioner according to claim 1, wherein the microprocessor executes determining the first communication speed of the control information a predetermined number of times.

3. The air conditioner according to claim 2, wherein the microprocessor executes determining the first communication speed of the control information a predetermined number of times and generates an alarm upon determining the first communication speed is not determined within the the predetermined number of times.

4. The air conditioner according to claim 1, wherein the plurality of communication terminals are connected to a common input port of the microprocessor through a bus line, and the control information signal from one of the communication terminals of the plurality of communication terminals is input to the common input port.

5. The air conditioner according to claim 4, wherein an opening and closing transistor is disposed in the bus line between the common input port and the plurality of communication terminals, and the bus line is blocked by the opening and closing transistor except for the communication terminal of which the communication speed is determined.

6. An air conditioner, comprising:

an outdoor unit including a first controller; and an indoor unit including:

a second controller connected to the first controller via a communication line and that includes power line communication means which uses a power line and dedicated line communication means which uses a dedicated line dedicated for communication, wherein the second controller of the indoor unit includes a microprocessor, programmed to:

receive a control information signal having a communication speed, determine whether the communication line from the outdoor unit is connected to any of the power line communication means or the dedicated line communication means, based on the communication speed of the control information signal, and determine whether subsequent communication of the control information signal is performed by the power line communication means or the dedicated line communication means, based on the recognized communication speed.

7. The air conditioner according to claim 6, wherein the power line communication means and the dedicated line communication means are connected to a common input port of the microcomputer through a bus line, and the control information signal from the power line communication means or the dedicated line communication means is input to the common input port, and wherein an opening and closing transistor is disposed in the bus line between the common input port and the power line communication means, and the bus line between the power line communication means and the common input port is blocked by the opening and closing transistor when the dedicated line communication means is determined.

8. An air conditioner, comprising:

an outdoor unit including a first controller; and an indoor unit including:

a second controller that includes a plurality of communication terminals connected to the first controller of the outdoor unit via a communication line, the plurality of communication terminals respectively corresponding to different predetermined communication speeds, wherein the second controller of the indoor unit includes a microprocessor, wherein the microprocessor stores a plurality of predetermined reading times respectively corresponding to the different predetermined communication speeds, wherein the microprocessor is programmed to:

receive a control information signal of a first communication speed, among the different predetermined communications speeds, determine which of the predetermined reading times reads the control information signal by reading the control information signal using at least a first read time that corresponds to a highest communication speed of the predetermined communication speeds, first, among the predetermined reading times, and perform subsequent communication with the first controller of the outdoor unit using the communication terminal that corresponds to the communication speed that corresponds to the determined reading time.

* * * * *